US011092362B2

(12) United States Patent
Nishio et al.

(10) Patent No.: US 11,092,362 B2
(45) Date of Patent: Aug. 17, 2021

(54) AIR-CONDITIONING DEVICE

(71) Applicant: Mitsubishi Electric Corporation, Chiyoda-ku (JP)

(72) Inventors: Jun Nishio, Chiyoda-ku (JP); Naofumi Takenaka, Chiyoda-ku (JP); Soshi Ikeda, Chiyoda-ku (JP); Raito Kawamura, Chiyoda-ku (JP); Hideto Nakao, Chiyoda-ku (JP); Katsuhiro Ishimura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 82 days.

(21) Appl. No.: 16/488,889

(22) PCT Filed: Apr. 24, 2017

(86) PCT No.: PCT/JP2017/016186
§ 371 (c)(1),
(2) Date: Aug. 26, 2019

(87) PCT Pub. No.: WO2018/198164
PCT Pub. Date: Nov. 1, 2018

(65) Prior Publication Data
US 2020/0284476 A1 Sep. 10, 2020

(51) Int. Cl.
*F25B 1/04* (2006.01)
*F25B 1/10* (2006.01)
(Continued)

(52) U.S. Cl.
CPC ..... *F25B 1/04* (2013.01); *F25B 1/10* (2013.01); *F25B 31/008* (2013.01); *F25B 41/385* (2021.01); *F25B 41/39* (2021.01)

(58) Field of Classification Search
CPC .. F25B 1/04; F25B 31/008; F25B 1/10; F25B 41/39; F25B 41/385; F25B 41/20
See application file for complete search history.

(56) References Cited

U.S. PATENT DOCUMENTS 4,475,360 A * 10/1984 Suefuji ..... F04C 18/0215 62/324.1
7,228,710 B2 * 6/2007 Lifson ..... F04C 18/0253 418/55.1
(Continued)

FOREIGN PATENT DOCUMENTS

GB 2530453 A 3/2016
JP 60-162158 A 8/1985
(Continued)

OTHER PUBLICATIONS

Office Action dated Dec. 17, 2020, in corresponding Chinese patent Application No. 201780089676.4, 14 pages.
(Continued)

*Primary Examiner* — Ana M Vazquez
(74) *Attorney, Agent, or Firm* — Xsensus LLP

(57) ABSTRACT

A compressor of an air-conditioning device includes a scroll mechanism unit having a fixed scroll and an orbiting scroll that cooperates with the fixed scroll to compress refrigerant. There is a first space portion provided between the scroll mechanism unit and an electric motion unit; an annular second space portion provided in a circumference of the scroll mechanism unit in a radial direction; a communication path provided between the first space portion and the second space portion, to guide, to the second space portion, the refrigerant sucked from the suction pipe to the first space portion. A part of the refrigerant between the first expansion valve and the second expansion valve is injected simultaneously to the first space portion and the second space portion.

14 Claims, 10 Drawing Sheets

(51) Int. Cl.

| | |
|---|---|
| ***F25B 31/00*** | (2006.01) |
| ***F25B 41/39*** | (2021.01) |
| ***F25B 41/385*** | (2021.01) |

(56) References Cited

U.S. PATENT DOCUMENTS

| | | | |
|---|---|---|---|
| 2015/0004040 | A1 | 1/2015 | Katou et al. |
| 2017/0335847 | A1 | 11/2017 | Kawamura et al. |

FOREIGN PATENT DOCUMENTS

| | | | |
|---|---|---|---|
| JP | 2-294580 | A | 12/1990 |
| JP | 9-303887 | A | 11/1997 |
| JP | 2001-12809 | A | 1/2001 |
| JP | 2013-79643 | A | 5/2013 |
| JP | 2014-119221 | A | 6/2014 |
| WO | WO 2015/001613 | A1 | 1/2015 |
| WO | WO 2016/079858 | A1 | 5/2016 |

OTHER PUBLICATIONS

International Search Report dated Jul. 18, 2017 in PCT/JP2017/016186 filed on Apr. 24, 2017.

* cited by examiner

AIR-CONDITIONING DEVICE

TECHNICAL FIELD

The present invention relates to an air-conditioning device that injects, to a compressor, a part of refrigerant circulating through a refrigerant circuit.

BACKGROUND ART

In an existing air-conditioning device, liquid refrigerant is injected to either of a compression chamber of a compressor or a suction portion of the compressor to lower a discharge temperature of the compressor (e.g., Patent Literature 1).

CITATION LIST

Patent Literature

Patent Literature 1: Japanese Unexamined Patent Application Publication No. 9-303887

SUMMARY OF INVENTION

Technical Problem

In such an air-conditioning device, when injected liquid refrigerant reaches a compression chamber, refrigerating machine oil is diluted. The refrigerating machine oil fills micro gaps of the compression chamber, thereby preventing the refrigerant of the compression chamber from leaking from the compression chamber on a high-pressure side to the compression chamber on a low-pressure side. Consequently, there are problems that decrease of viscosity due to the dilution of the refrigerating machine oil causes the leakage of the refrigerant and that efficiency of the compressor decreases. There is another problem that the liquid refrigerant injected to a suction portion of the compressor flows into an oil reservoir of a bottom portion of the compressor, thereby decreasing the viscosity of the refrigerating machine oil.

The present invention has been made to solve such problems as described above, and an object thereof is to provide an air-conditioning device that suppresses decrease of efficiency of a compressor and decrease of viscosity of refrigerating machine oil during injection of refrigerant.

Solution to Problem

According to an embodiment of the present invention, there is provided an air-conditioning device, comprising: a refrigerant circuit in which a compressor, a four-way valve, an outdoor heat exchanger, a first expansion valve, a second expansion valve and an indoor heat exchanger are connected by a refrigerant pipe, and an injection circuit, wherein the compressor includes: a scroll mechanism unit having a fixed scroll and an orbiting scroll that cooperates with the fixed scroll to compress refrigerant, an electric motion unit that provides revolution movement to the orbiting scroll, a first space portion provided between the scroll mechanism unit and the electric motion unit, an annular second space portion provided in a circumference of the scroll mechanism unit in a radial direction, a suction pipe connected to the first space portion, from which the refrigerant is sucked into the compressor, a communication path provided between the first space portion and the second space portion to guide, to the second space portion, the refrigerant sucked from the suction pipe to the first space portion, and a discharge pipe that discharges, to outside of the compressor, the refrigerant that flows from the second space portion into the scroll mechanism unit and is compressed, wherein the injection circuit injects a part of the refrigerant between the first expansion valve and the second expansion valve simultaneously to the first space portion and the second space portion.

Advantageous Effects of Invention

According to an embodiment of the present invention, a part of low-temperature refrigerant flowing through a refrigerant pipe between a first expansion valve and a second expansion valve is distributed to a first injection pipe and a second injection pipe. Then, the distributed refrigerant is injected from the first injection pipe to a first space portion of a compressor and evaporated by heat generated by an electric motion unit, to thereby cool the refrigerant flowing from a four-way valve into the first space portion. Consequently, the refrigerant from the first injection pipe turns into a gas, and an only small amount of refrigerating machine oil in the compressor is diluted. As a result, decrease of viscosity of the refrigerating machine oil can be suppressed.

Furthermore, the distributed refrigerant from the second injection pipe is injected to join the refrigerant flowing from the first space portion into a second space portion, and is incorporated into a scroll mechanism unit. According to this configuration, leakage of the refrigerant in the scroll mechanism unit due to the viscosity decrease of the refrigerating machine oil can be decreased, and efficiency decrease of the compressor can be suppressed.

DESCRIPTION OF EMBODIMENTS

Embodiment 1

(Configuration of Air-Conditioning Device)

Figure 1:
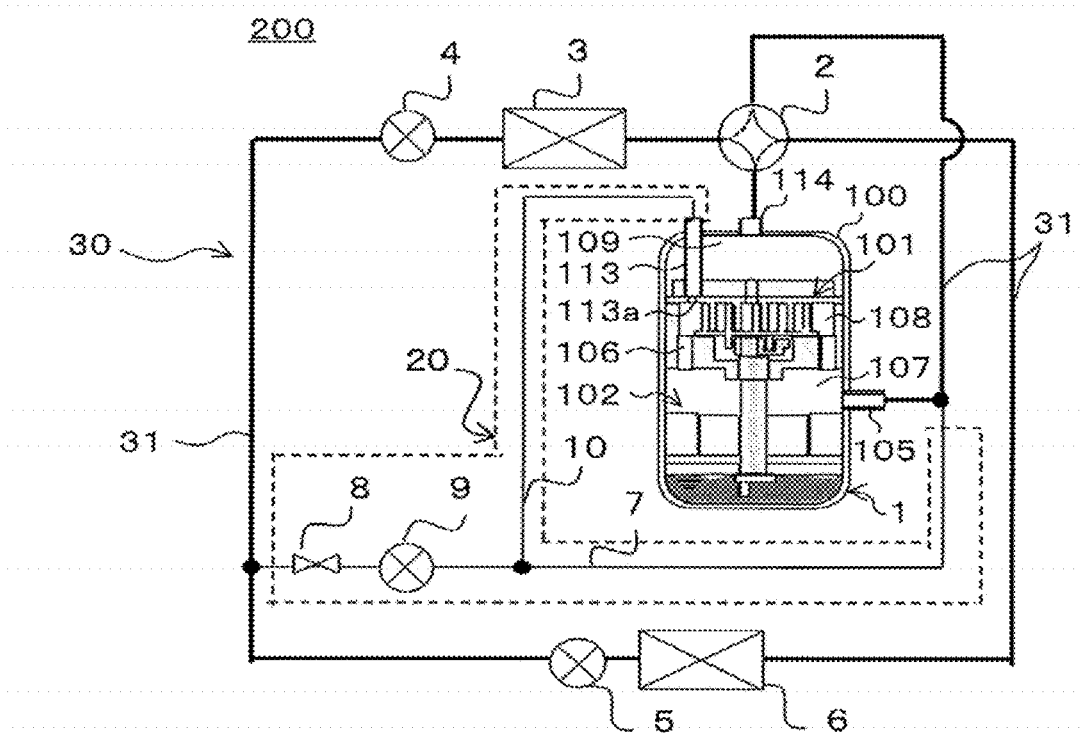
FIG. 1 is a schematic circuit diagram showing an example of a circuit configuration of an air-conditioning device according to Embodiment 1 of the present invention.

FIG. 1 is a schematic circuit diagram showing an example of a circuit configuration of an air-conditioning device according to Embodiment 1 of the present invention.

An air-conditioning device 200 of Embodiment 1 includes a refrigerant circuit 30 in which a compressor 1, a four-way valve 2, an outdoor heat exchanger 3, a first expansion valve 4, a second expansion valve 5 and an indoor heat exchanger 6 are connected sequentially by a refrigerant pipe 31, and an injection circuit 20 (a part shown by surrounding broken line).

The compressor 1 has a sealed container 100, a scroll mechanism unit 101 contained in the sealed container 100, and an electric motion unit 102 that drives the scroll mechanism unit 101. Note that a detailed configuration of the compressor 1 will be described with reference to FIG. 2 and FIG. 3.

The four-way valve 2 is a switch valve that switches a flow direction of the refrigerant. During a cooling operation mode, the four-way valve 2 switches a flow path so that the refrigerant discharged from the compressor 1 flows to the outdoor heat exchanger 3, and switches the flow path so that the refrigerant from the indoor heat exchanger 6 flows into the compressor 1. During a heating operation mode, the four-way valve 2 switches the flow path so that the refrigerant discharged from the compressor 1 flows to the indoor heat exchanger 6, and switches the flow path so that the refrigerant from the outdoor heat exchanger 3 flows into the compressor 1. The switch valve that switches the flow path in this manner may include any combination of a plurality of valves such as a two-path switch valve and a three-path switch valve.

The outdoor heat exchanger 3 functions as a condenser during the cooling operation mode, and functions as an evaporator during the heating operation mode, to thereby exchange heat between the refrigerant and outdoor air. The indoor heat exchanger 6 functions as the evaporator during the cooling operation mode, and functions as the condenser during the heating operation mode, to thereby exchange heat between the refrigerant and indoor air. Note that FIG. 1 shows one indoor heat exchanger 6, but two or more indoor heat exchangers 6 may be connected in parallel.

The second expansion valve 5 includes, for example, an electronic expansion valve having an adjustable opening degree to decompress the refrigerant from a high pressure to a low pressure during the cooling operation mode and to decompress the refrigerant from the high pressure to an injection pressure during the heating operation mode. Note that the high pressure is approximately a discharge pressure of the compressor 1, and the low pressure is approximately a suction pressure of the compressor 1. The injection pressure is a pressure required to perform the injection. The first expansion valve 4 includes, for example, an electronic expansion valve having an adjustable opening degree, so that the valve is fully open and does not decompress the refrigerant during the cooling operation mode and so that the valve decompresses the refrigerant from the injection pressure to the low pressure during the heating operation mode.

The injection circuit 20 includes a first injection pipe 7 connected at one end to the refrigerant pipe 31 between the first expansion valve 4 and the second expansion valve 5 and connected at the other end to the refrigerant pipe 31 between the four-way valve 2 and a suction pipe 105 of the compressor 1; an injection valve 8 and an throttle unit 9 provided in the first injection pipe 7; and a second injection pipe 10 connected at one end to a position in the first injection pipe 7 on a refrigerant outflow side of the throttle unit 9, and coupled at the other end to an injection pipe 113 extending through an upper portion of the compressor 1 to communicate with a second space portion 108. Note that the first injection pipe 7 may be coupled to the compressor 1 so that the other end of the first injection pipe is directly connected to a first space portion 107 of the compressor 1.

When the outdoor heat exchanger 3 or the indoor heat exchanger 6 functions as the condenser and the injection valve 8 opens, the low-temperature refrigerant (liquid refrigerant) condensed in the outdoor heat exchanger 3 or the indoor heat exchanger 6 flows into the first injection pipe 7. A flow rate of the refrigerant flowing into the first injection pipe 7 is adjusted by the throttle unit 9. A part of the refrigerant flowing through the throttle unit 9 flows into the first space portion 107 of the compressor 1 via the first injection pipe 7. On the other hand, the residual refrigerant flows into the second injection pipe 10, and flows into the second space portion 108 of the compressor 1. That is, a part of the refrigerant flowing through the refrigerant pipe 31 between the first expansion valve 4 and the second expansion valve 5 is taken in parallel to the first injection pipe 7 and the second injection pipe 10, and injected simultaneously to the first space portion 107 and the second space portion 108 of the compressor 1. Note that the throttle unit 9 includes, for example, an electronic expansion valve having an adjustable opening degree.

Figure 2:
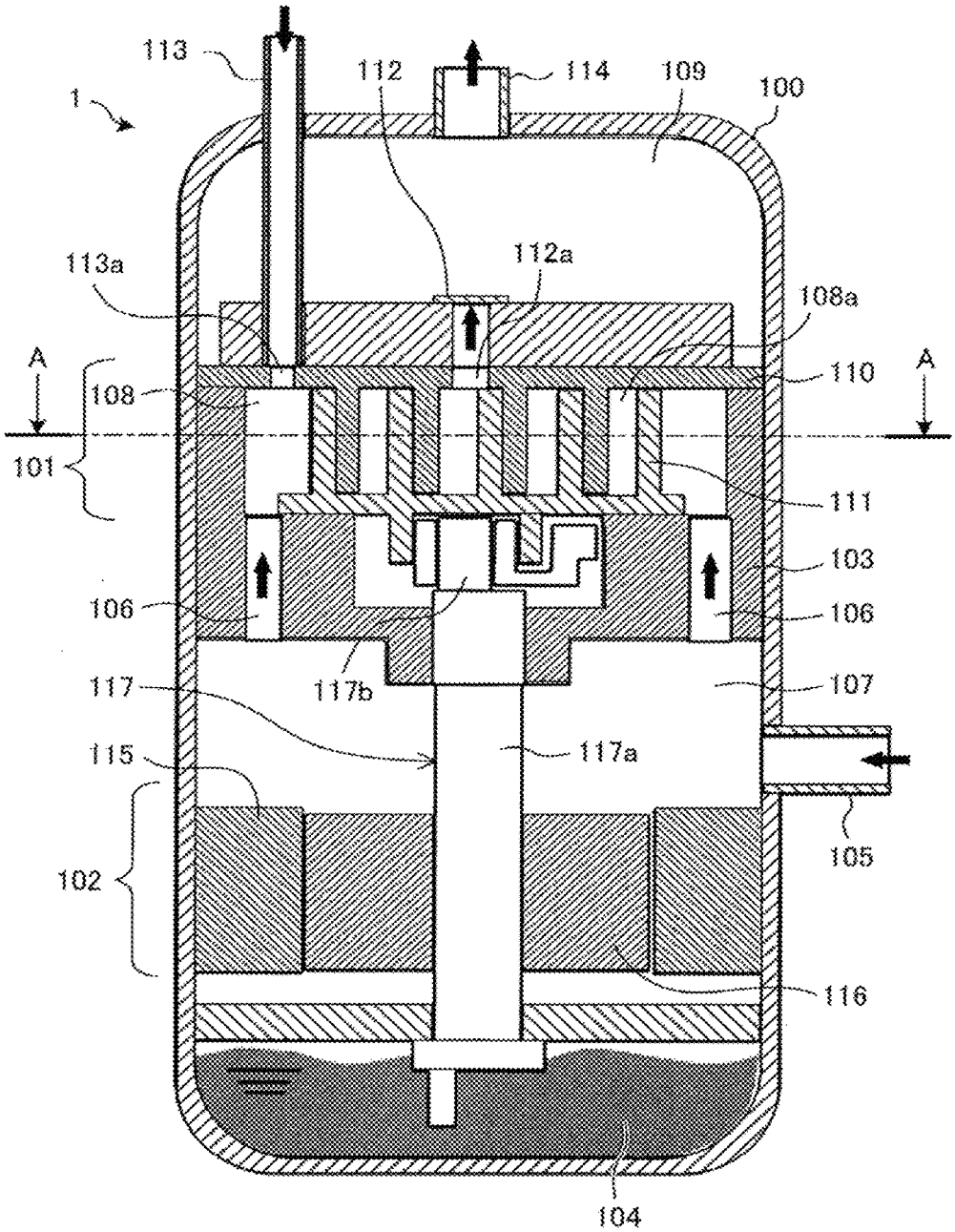
FIG. 2 is an enlarged vertical sectional view showing a compressor of FIG. 1.
Figure 3:
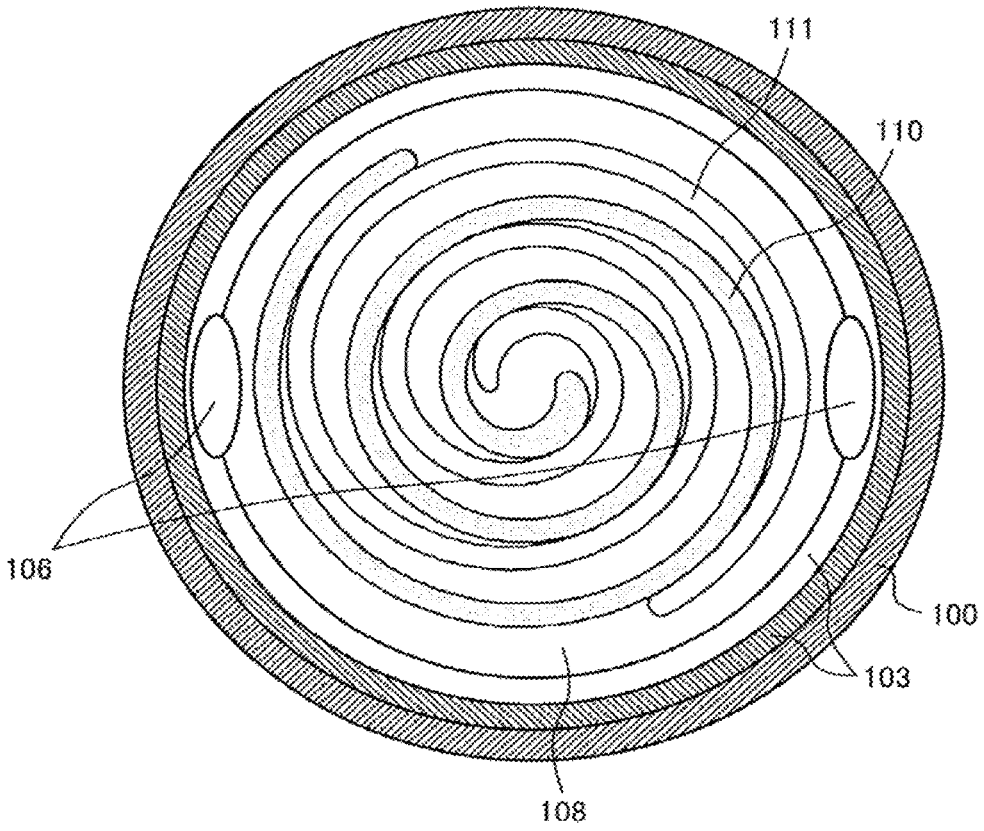
FIG. 3 is a cross-sectional view along the line A-A of FIG. 2.

FIG. 2 is a vertical sectional view showing an enlarged compressor of FIG. 1, and FIG. 3 is a cross-sectional view along the line A-A of FIG. 2.

The compressor 1 is a low-pressure shell type scroll compressor that sucks the low-temperature and low-pressure refrigerant from the suction pipe 105 to compress the refrigerant into the high-temperature and high-pressure refrigerant. Furthermore, in the compressor 1, the electric motion unit 102 is used in which a capacity can be controlled by an inverter. Note that the low-pressure shell type refers to a structure of the compressor in which the sealed container 100 contains a compression chamber 108*a*, an interior of the sealed container 100 is a low-pressure refrigerant atmosphere, and the low-temperature and low-pressure refrigerant is sucked into the sealed container 100 to compress the refrigerant in the compression chamber 108*a*.

As shown in FIG. 2, the compressor 1 includes, as main components, the scroll mechanism unit 101 disposed on an upper side in the sealed container 100, the electric motion unit 102 disposed on a lower side in the sealed container 100, and a frame 103 that supports the scroll mechanism unit 101 from below. An oil reservoir 104 is provided in a bottom portion of the sealed container 100. The oil reservoir 104 stores refrigerating machine oil that lubricates the scroll mechanism unit 101 and a sliding part such as a bearing.

Further, in the sealed container 100, the first space portion 107, the second space portion 108 and a third space portion 109 are provided. The first space portion 107 is provided between the frame 103 that supports the scroll mechanism unit 101 and the electric motion unit 102, and communicates with the suction pipe 105 connected to the sealed container 100. The second space portion 108 is defined by the frame 103 and formed in an annular shape in a circumference of the scroll mechanism unit 101 in a radial direction, and communicates with the injection pipe 113 via a refrigerant inflow hole 113*a* provided in a fixed scroll 110 described later.

Furthermore, the second space portion 108 communicates with the first space portion 107 through a communication path 106 provided in the frame 103. The refrigerant inflow hole 113*a* and the communication path 106 are displaced from each other in the radial direction of the scroll mechanism unit 101. Due to this positional relation, the refrigerant passed through the refrigerant inflow hole 113*a* does not flow backward to the first space portion 107 through the communication path 106. Therefore, the refrigerant flowing through the second injection pipe 10 is not affected by heat generated from the electric motion unit 102, and does not dilute the refrigerating machine oil of the oil reservoir 104. The third space portion 109 is provided above the scroll mechanism unit 101, and communicates with a discharge pipe 114 connected to the upper portion of the sealed container 100.

The scroll mechanism unit 101 includes the fixed scroll 110, and an orbiting scroll 111 disposed under the fixed scroll 110. The fixed scroll 110 is fixed to an upper end of the frame 103 to close an upper opening port of the frame 103. A refrigerant outflow hole 112*a*, through which the refrigerant compressed in the compression chamber 108*a* is guided upward, is provided in a center of an upper end of the fixed scroll 110. A discharge valve 112 that discharges the refrigerant compressed in the compression chamber 108*a* to the third space portion 109 is provided above the refrigerant outflow hole 112*a* so that it can be opened and closed. The orbiting scroll 111 is coupled to an eccentric shaft portion 117*b* provided on an inner side of a center of the frame 103.

The electric motion unit 102 includes an annular stator 115, a rotor 116 inserted in the stator 115 such that it can rotate, and a rotary shaft 117. The rotary shaft 117 includes a main shaft portion 117*a* to which the rotor 116 is shrink fitted or pressed, and the eccentric shaft portion 117*b* fitted into the orbiting scroll 111. The electric motion unit 102 provides revolution movement to the orbiting scroll while eccentrically moving the eccentric shaft portion 117*b* to rotation of the main shaft portion 117*a*. The orbiting scroll 111 revolves in conjunction with the revolution movement of the eccentric shaft portion 117*b*, and cooperates with the fixed scroll 110 to supply the refrigerant of the second space portion 108 to the compression chamber 108*a*, thereby compressing the refrigerant. The high-temperature and high-pressure refrigerant compressed by the fixed scroll 110 and the orbiting scroll 111 is discharged from the discharge valve 112 to the third space portion 109 through the refrigerant outflow hole 112*a*. The high-temperature and high-pressure refrigerant discharged to the third space portion 109 flows from the discharge pipe 114 into the refrigerant pipe 31.

Next, an explanation will be made on operations of the air-conditioning device 200 having the above configuration during the cooling operation mode and during the heating operation mode.

(Cooling Operation Mode)

Figure 4:
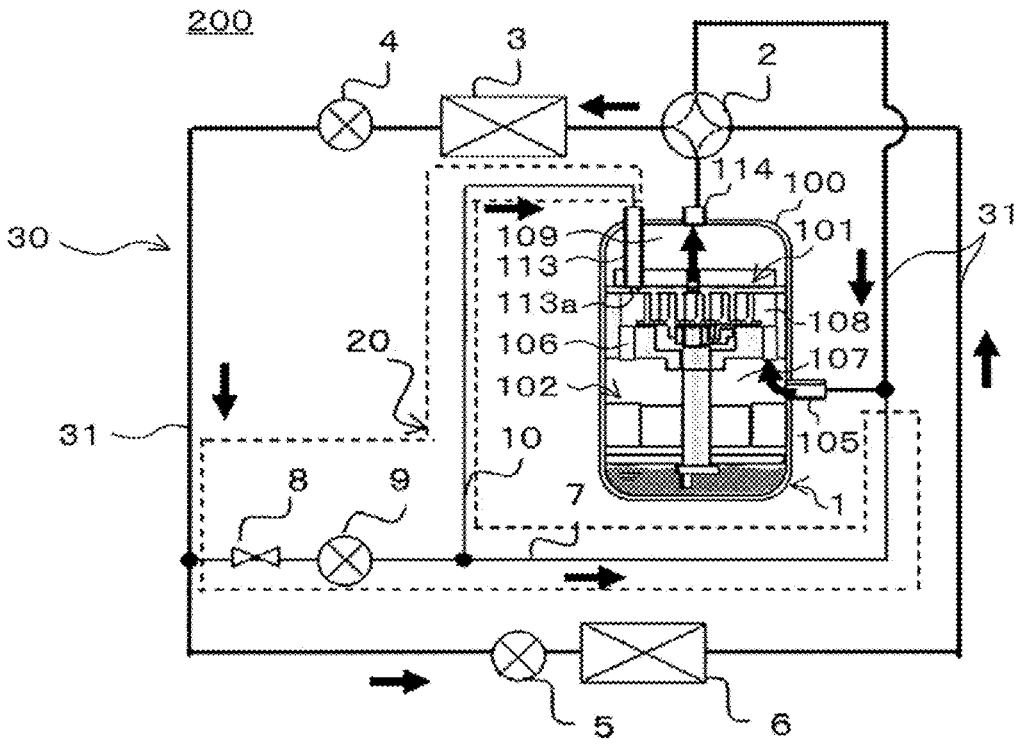
FIG. 4 is a circuit diagram showing flow of refrigerant during a cooling operation mode of the air-conditioning device of FIG. 1.

FIG. 4 is a circuit diagram showing flow of the refrigerant during the cooling operation mode of the air-conditioning device of FIG. 1. Note that arrows in the drawing show the flow direction of the refrigerant.

First, the flow of the refrigerant in the refrigerant circuit 30 will be described.

The compressor 1 sucks and compresses the low-temperature and low-pressure refrigerant, and discharges the high-temperature and high-pressure refrigerant. The high-temperature and high-pressure refrigerant discharged from the compressor 1 flows into the outdoor heat exchanger 3 via the four-way valve 2. The refrigerant flowing into the outdoor heat exchanger 3 radiates heat to the outdoor air to condense. The refrigerant (liquid refrigerant) condensed in the outdoor heat exchanger 3 is not decompressed in the first expansion valve 4 and flows into the second expansion valve 5, and is decompressed from the high pressure to the low pressure. The refrigerant decompressed to the low pressure in the second expansion valve 5 flows into the indoor heat exchanger 6, and absorbs heat from the indoor air to evaporate. The refrigerant (gas refrigerant) evaporated in the indoor heat exchanger 6 has the low temperature and low pressure, and is again sucked to the compressor 1 via the four-way valve 2.

Next, the flow of the refrigerant in the injection circuit 20 will be described.

When the injection valve 8 and the throttle unit 9 are opened, a part of the low-temperature refrigerant condensed in the outdoor heat exchanger 3 flows into the first injection pipe 7, and flows through the first injection pipe 7 via the injection valve 8 and the throttle unit 9. A part of the refrigerant flowing through the first injection pipe 7 flows into the first space portion 107 of the compressor 1 together with the low-temperature and low-pressure refrigerant from the four-way valve 2, and the residual refrigerant flows into the second space portion 108 of the compressor 1 via the second injection pipe 10 and the injection pipe 113.

The low-temperature refrigerant flowing from the first injection pipe 7 into the first space portion 107 is evaporated by the heat generated from the electric motion unit 102, to cool the refrigerant from the four-way valve 2. The cooled refrigerant flows through the communication path 106 into the second space portion 108, and joins the low-temperature refrigerant flowing through the injection pipe 113 into the second space portion 108. The joined refrigerant is compressed by the fixed scroll 110 and the orbiting scroll 111 to be the high-temperature and high-pressure refrigerant. The high-temperature and high-pressure refrigerant is discharged from the discharge valve 112 to the third space portion 109 through the refrigerant outflow hole 112*a*, to thereby flow from the discharge pipe 114 into the refrigerant pipe 31.

Next, operations of the injection valve 8 and the throttle unit 9 of the injection circuit 20 will be described.

When the air-conditioning device 200 starts, the injection valve 8 is closed. This does not hinder the flow of the refrigerant flowing through the refrigerant circuit 30. After the start of the air-conditioning device 200, the injection valve 8 is opened, and the opening degree of the throttle unit 9 is adjusted to determine a flow rate of the refrigerant flowing through the injection circuit 20. The opening degree of the throttle unit 9 is determined, for example, in accordance with a rotation speed of the compressor 1, an indoor temperature, an outdoor temperature, and pressure loss in the injection circuit 20.

(Effects During Cooling Operation Mode)

As described above, in the injection circuit 20 during the cooling operation mode, a part of the low-temperature refrigerant condensed in the outdoor heat exchanger 3 flows into each of the first space portion 107 and the second space portion 108 of the compressor 1. Then, the refrigerant injected to the first space portion 107 is evaporated by the heat generated from the electric motion unit 102 to cool the refrigerant from the four-way valve 2, and the cooled refrigerant flows from the communication path 106 into the second space portion 108, to thereby join the refrigerant flowing into the second space portion 108. The joined refrigerant is supplied into the scroll mechanism unit 101. According to this configuration, advantageous effects are obtained as follows.

(1) A part of the low-temperature refrigerant condensed in the outdoor heat exchanger 3 is injected to the refrigerant flowing from the four-way valve 2 into the first space portion 107 of the compressor 1, to cool the refrigerant flowing into the first space portion 107. Consequently, the temperature of the refrigerant discharged from the discharge pipe 114 of the compressor 1 can be lowered.

(2) The low-temperature refrigerant flowing into the second space portion 108 of the compressor 1 is injected to join the refrigerant flowing from the first space portion 107 into the second space portion 108, and the joined refrigerant is supplied to the scroll mechanism unit 101. Consequently, the refrigerating machine oil in the compressor 1 is hard to be diluted. As a result, decrease of viscosity of the refrigerating machine oil can be inhibited and reliability of the compressor 1 can be acquired.

(3) As described above, the refrigerant injected into the first space portion 107 is evaporated by the heat generated from the electric motion unit 102, so that the dilution of the refrigerating machine oil can be inhibited. As a result, it is possible to decrease leakage of the refrigerant from the compression chamber on the high-pressure side to the compression chamber on the low-pressure side in the scroll mechanism unit 101, and decrease of efficiency of the compressor 1 can be inhibited.

(4) The decrease of the viscosity of the refrigerating machine oil and the decrease of the efficiency of the compressor 1 are inhibited. Consequently, an amount of the refrigerant to be injected to the first space portion 107 and the second space portion 108 of the compressor 1 can be increased, and a discharge temperature can be lowered. In particular, when the refrigerant to be applied to the air-conditioning device 200 is a refrigerant, such as R32 refrigerant, that has a higher discharge temperature of the compressor 1 than R410A refrigerant, the amount of the refrigerant to be injected is effectively increased to lower the discharge temperature.

(5) When the refrigerant flowing from the four-way valve 2 into the first space portion 107 of the compressor 1 is cooled, input of the compressor 1 can be decreased, and a coefficient of performance (COP, i.e., a cooling and heating capacity/the compressor input) can be improved.

(6) The amount of the refrigerant increases to be larger than an amount of refrigerant of the refrigerant circuit 30 that does not include the injection circuit 20, but a density of the refrigerant to be sucked into the compressor 1 increases. Consequently, it is not necessary to increase a rotation speed of the compressor 1.

(Heating Operation Mode)

Figure 5:
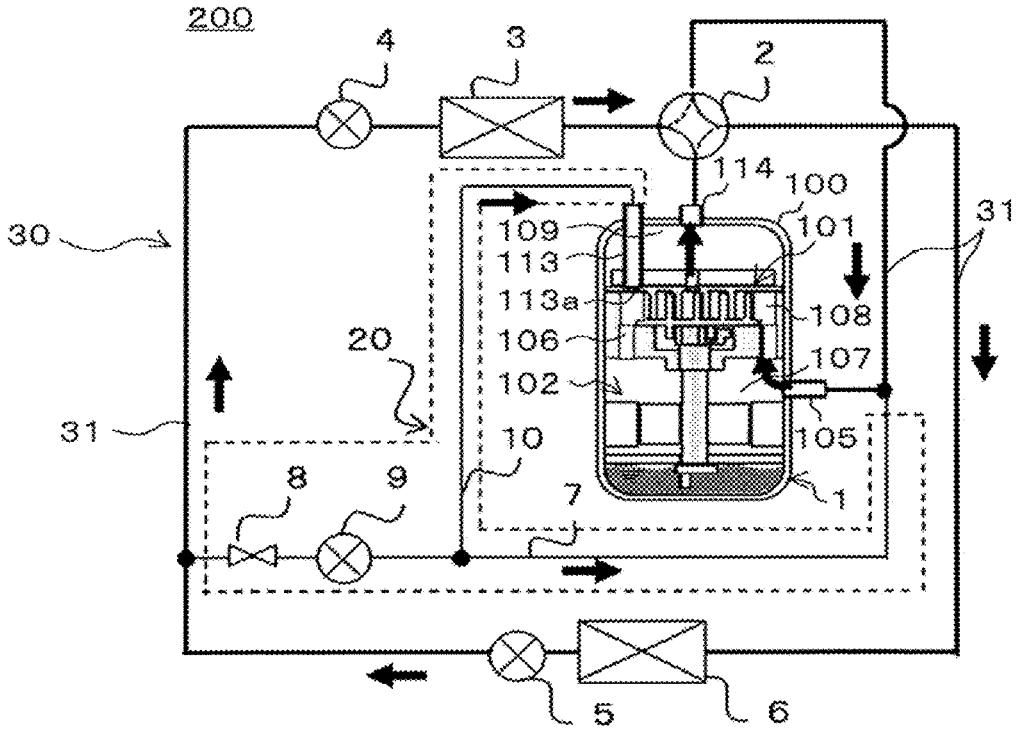
FIG. 5 is a schematic circuit diagram showing flow of the refrigerant during a heating operation mode of the air-conditioning device according to Embodiment 1 of the present invention.

FIG. 5 is a schematic circuit diagram showing flow of the refrigerant during the heating operation mode of the air-conditioning device of FIG. 1. Note that arrows in the drawing indicate the flow direction of the refrigerant.

First, the flow of the refrigerant in the refrigerant circuit 30 will be described.

The compressor 1 sucks and compresses the low-temperature and low-pressure refrigerant, and discharges the high-temperature and high-pressure refrigerant. The high-temperature and high-pressure refrigerant discharged from the compressor 1 flows into the indoor heat exchanger 6 via the four-way valve 2. The refrigerant flowing into the indoor heat exchanger 6 radiates heat to the indoor air to condense. The refrigerant (liquid refrigerant) condensed in the indoor heat exchanger 6 is decompressed from the high pressure to the injection pressure in the second expansion valve 5, and further decompressed from the injection pressure to the low pressure in the first expansion valve 4. The refrigerant decompressed in the first expansion valve 4 flows into the outdoor heat exchanger 3, and absorbs heat from the outdoor air to evaporate. The refrigerant (gas refrigerant) evaporated in the outdoor heat exchanger 3 has the low temperature and the low pressure and is again sucked into the compressor 1 via the four-way valve 2.

Next, the flow of the refrigerant in the injection circuit 20 will be described.

The flow of the refrigerant is the same as in the cooling operation mode, but the pressure of the refrigerant flowing into the injection circuit 20 is lower than the pressure during the cooling operation mode. Consequently, the opening degree of the throttle unit 9 is larger than the opening degree during the cooling operation mode.

When the injection valve 8 and the throttle unit 9 are opened, a part of the low-temperature refrigerant condensed in the indoor heat exchanger 6 flows into the first injection pipe 7, and flows through the first injection pipe 7 via the injection valve 8 and the throttle unit 9. A part of the refrigerant flowing through the first injection pipe 7 flows into the first space portion 107 of the compressor 1 together with the low-temperature and low-pressure refrigerant from the four-way valve 2, and the residual refrigerant flows into the second space portion 108 of the compressor 1 via the second injection pipe 10 and the injection pipe 113.

The refrigerant flowing from the first injection pipe 7 into the first space portion 107 is evaporated by the heat generated from the electric motion unit 102, to thereby cool the refrigerant from the four-way valve 2. The cooled refrigerant flows through the communication path 106 into the second space portion 108, and joins the refrigerant flowing through the injection pipe 113 into the second space portion 108. The joined refrigerant is compressed by the fixed scroll 110 and the orbiting scroll 111 to be the high-temperature and high-pressure refrigerant. The high-temperature and high-pressure refrigerant is discharged from the discharge valve 112 to the third space portion 109 through the refrigerant outflow hole 112*a*, to flow from the discharge pipe 114 into the refrigerant pipe 31.

Note that the operations of the injection valve 8 and the throttle unit 9 of the injection circuit 20 are the same as in the cooling operation mode.

(Effects During Heating Operation Mode)

As described above, in the injection circuit 20 during the heating operation mode, a part of the low-temperature refrigerant condensed in the indoor heat exchanger 6 flows into each of the first space portion 107 and the second space portion 108 of the compressor 1. Then, the refrigerant injected to the first space portion 107 is evaporated by the heat generated from the electric motion unit 102 to cool the refrigerant from the four-way valve 2, and the cooled refrigerant flows from the communication path 106 into the second space portion 108, to join the refrigerant flowing into the second space portion 108. The joined refrigerant is taken into the scroll mechanism unit 101. According to this configuration, effects are obtained as follows.

(1) A part of the low-temperature refrigerant condensed in the indoor heat exchanger 6 is injected to the refrigerant flowing from the four-way valve 2 into the first space portion 107 of the compressor 1, to cool the refrigerant flowing into the first space portion 107. Consequently, the temperature of the refrigerant discharged from the discharge pipe 114 of the compressor 1 can be lowered.

(2) The low-temperature refrigerant flowing into the second space portion 108 of the compressor 1 joins the refrigerant flowing from the first space portion 107 into the second space portion 108, and is taken into the scroll mechanism unit 101. Consequently, the refrigerating machine oil in the compressor 1 is hard to be diluted. In consequence, the decrease of the viscosity of the refrigerating machine oil can be inhibited, and the reliability of the compressor 1 can be acquired.

(3) As described above, the refrigerant injected to the first space portion 107 is evaporated by the heat generated from the electric motion unit 102, and hence, the dilution of the refrigerating machine oil can be inhibited. As a result, it is possible to decrease the leakage of the refrigerant from the compression chamber on the high-pressure side to the compression chamber on the low-pressure side in the scroll mechanism unit 101, and the decrease of the efficiency of the compressor 1 can be inhibited.

(4) The decrease of the viscosity of the refrigerating machine oil and the decrease of the efficiency of the compressor 1 are suppressed. Consequently, the amount of the refrigerant to be injected to the first space portion 107 and the second space portion 108 of the compressor 1 can be increased, and the discharge temperature can be further lowered. In particular, when the refrigerant to be applied to the air-conditioning device 200 is a refrigerant, such as R32 refrigerant, that has a higher discharge temperature of the compressor 1 than R410A refrigerant, the amount of the refrigerant to be injected is effectively increased to lower the discharge temperature.

(5) When the refrigerant flowing from the four-way valve 2 into the first space portion 107 of the compressor 1 is cooled, the input of the compressor 1 can be decreased, and the COP can be improved.

(6) The amount of the refrigerant increases to be larger than the amount of refrigerant of the refrigerant circuit 30 that does not include the injection circuit 20, but the density of the refrigerant to be sucked into the compressor 1 increases. Consequently, it is not necessary to increase the rotation speed of the compressor 1.

(7) The discharge temperature of the compressor 1 can be lowered to decrease an amount of heat to be radiated to air from the refrigerant between the compressor 1 and the indoor heat exchanger 6. In a steady state, the amount of the heat to be radiated and an amount of heat to be absorbed are equal while the refrigerant circulates through the refrigerant circuit 30 once. Therefore, the amount of the heat to be absorbed in the outdoor heat exchanger 3 decreases due to the above described decrease of the amount of the heat to be radiated, and load on the outdoor heat exchanger 3 can be lowered. As a result, an evaporating temperature of the outdoor heat exchanger 3 rises, and COP can be improved.

Note that this effect of the COP improvement cannot be obtained during the cooling operation mode. This is because the amount of the heat to be absorbed in the indoor heat exchanger 6 is required to be constant, to keep a cooling capacity of the air-conditioning device 200 constant. As a result, when the amount of the heat to be radiated to the air from the refrigerant between the compressor 1 and the outdoor heat exchanger 3 decreases, the amount of the heat to be radiated in the outdoor heat exchanger 3 increases.

(8) The injection refrigerant branches to two paths, and pressure loss in an injection pipe having the two paths is smaller than pressure loss in an injection pipe having one path. Consequently, the injection pressure can decrease. As a result, the density of the refrigerant in the refrigerant pipe 31 between the second expansion valve 5 and the first expansion valve 4 decreases, and the amount of the refrigerant in the air-conditioning device 200 can be decreased. In particular, for example, in the air-conditioning device, such as a multi-air-conditioning apparatus for a building, in which the refrigerant pipe between the outdoor heat exchanger and the indoor heat exchanger is long, this effect of decreasing this amount of the refrigerant is remarkably exhibited.

Embodiment 2

Figure 6:
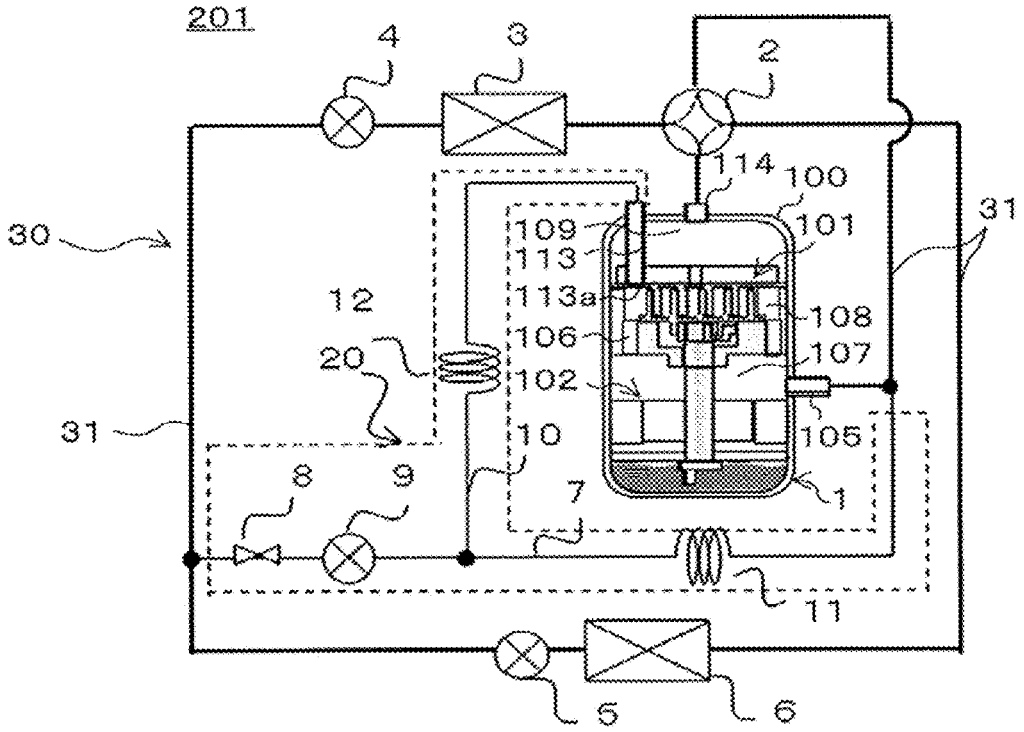
FIG. 6 is a schematic circuit diagram showing an example of a circuit configuration of an air-conditioning device according to Embodiment 2 of the present invention.

FIG. 6 is a schematic circuit diagram showing an example of a circuit configuration of an air-conditioning device according to Embodiment 2 of the present invention. Note that in Embodiment 2, components having the same configuration as in the air-conditioning device 200 of FIG. 1 are denoted by the same reference signs and description thereof is omitted.

An air-conditioning device 201 according to Embodiment 2 is different from the air-conditioning device 200 of FIG. 1 in that, for example, a first capillary tube 11 as a second throttle unit is provided at a position in a first injection pipe 7 on a refrigerant outflow side of a first throttle unit 9, and, for example, a second capillary tube 12 as a third throttle unit is provided in a second injection pipe 10.

An injection circuit 20 of Embodiment 2 is set so that a flow ratio between the first injection pipe 7 and the second injection pipe 10 does not deviate. For example, the flow ratio deviates because the second injection pipe 10 has a large difference in height from the first injection pipe 7 or has a long pipe or for another reason. In this case, a length of the second capillary tube 12 on a side closer to a second injection pipe 10 is adjusted to be shorter than a length of the first capillary tube 11.

As described above, the length of either of the first capillary tube 11 and the second capillary tube 12 is adjusted so that the flow ratio between the first injection pipe 7 and the second injection pipe 10 does not deviate. Consequently, it is possible to inhibit viscosity decrease of refrigerating machine oil or refrigerant leakage caused by the viscosity decrease of the refrigerating machine oil. In consequence, efficiency decrease of a compressor 1 can be more securely prevented.

Note that in Embodiment 2, it has been described that the first injection pipe 7 is provided with the first capillary tube 11, and the second injection pipe 10 is provided with the second capillary tube 12, but the first injection pipe 7 and the second injection pipe 10 may be provided with throttle units, respectively, in place of the first capillary tube 11 and the second capillary tube 12. That is, when opening degrees of the two throttle units are adjusted, deviation of a flow rate of the refrigerant to be injected to a first space portion 107 and a second space portion 108 can be easily adjusted.

Figure 14:
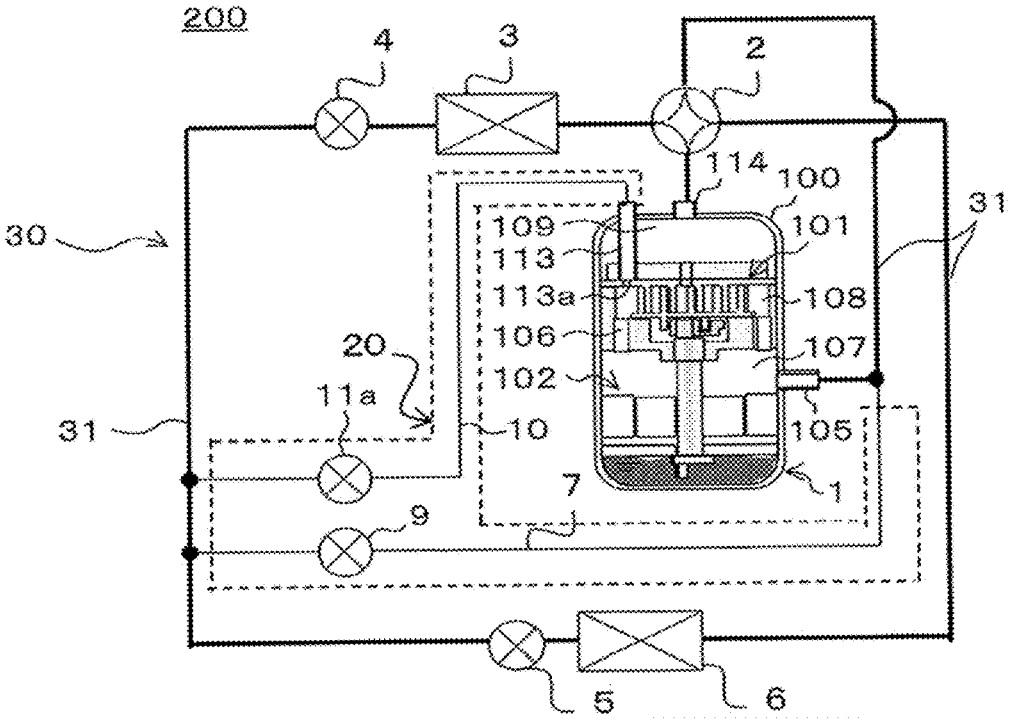
FIG. 14 is a schematic circuit diagram showing Modification 1 of the air-conditioning device of FIG. 6.

Furthermore, in Embodiment 2, it has been described that the first injection pipe 7 is provided with the throttle unit 9 and the first capillary tube 11, and the second injection pipe 10 branches from the first injection pipe between the throttle unit and the first capillary tube. However, the air-conditioning device may be configured, for example, as shown in FIG. 14. FIG. 14 is a schematic circuit diagram showing Modification 1 of the air-conditioning device of FIG. 6. In Modification 1, a second injection pipe 10 directly branches from a refrigerant pipe 31 between a first expansion valve 4 and a second expansion valve 5, and extends in parallel to a first injection pipe 7. A throttle unit 9 is provided as a first throttle unit 9 in the first injection pipe 7, and a second throttle unit 11*a* is provided in the second injection pipe 10. Also in this case, when opening degrees of the first and second throttle units 9 and 11*a* are adjusted, deviation of a flow rate of refrigerant to be injected to a first space portion 107 and a second space portion 108 can be easily adjusted.

Figure 15:
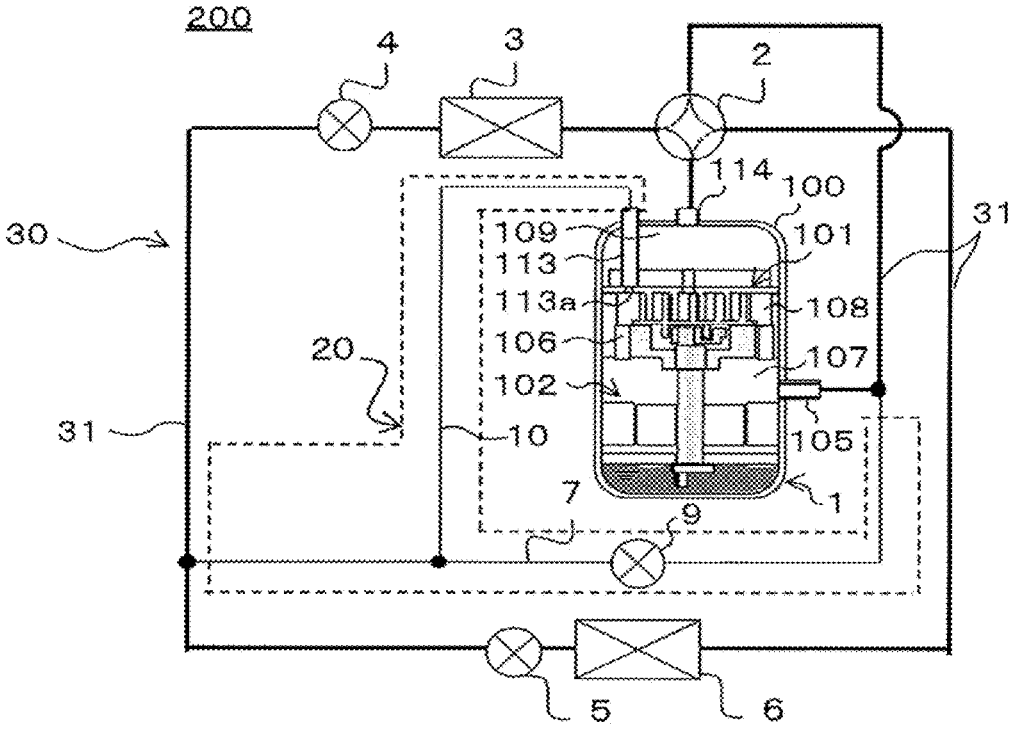
FIG. 15 is a schematic circuit diagram showing Modification 2 of the air-conditioning device of FIG. 6.

Additionally, the air-conditioning device may be configured, for example, as shown in FIG. 15. FIG. 15 is a schematic circuit diagram showing Modification 2 of the air-conditioning device of FIG. 6. In Modification 2, a first injection pipe 7 is only provided with a throttle unit 9, and a second injection pipe 10 may branch from a refrigerant inflow side of the throttle unit. In this case, when an opening degree of the throttle unit 9 is adjusted, deviation of a flow rate of refrigerant injected to a first space portion 107 and a second space portion 108 can be easily adjusted.

Embodiment 3

Figure 7:
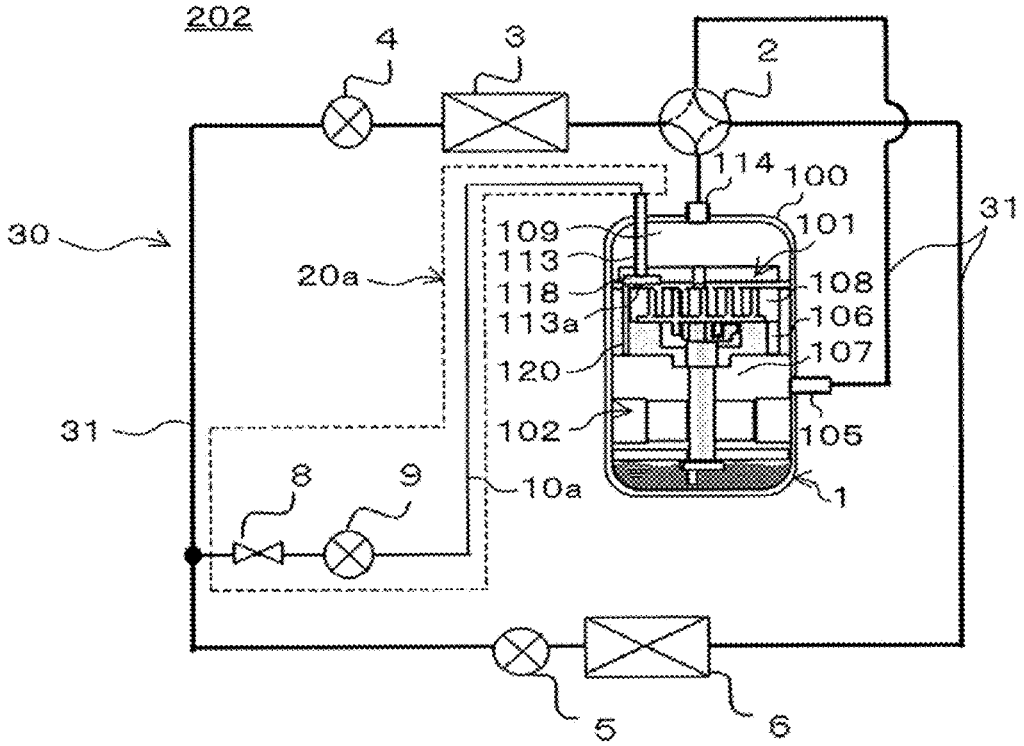
FIG. 7 is a schematic circuit diagram showing an example of a circuit configuration of an air-conditioning device according to Embodiment 3 of the present invention.
Figure 8:
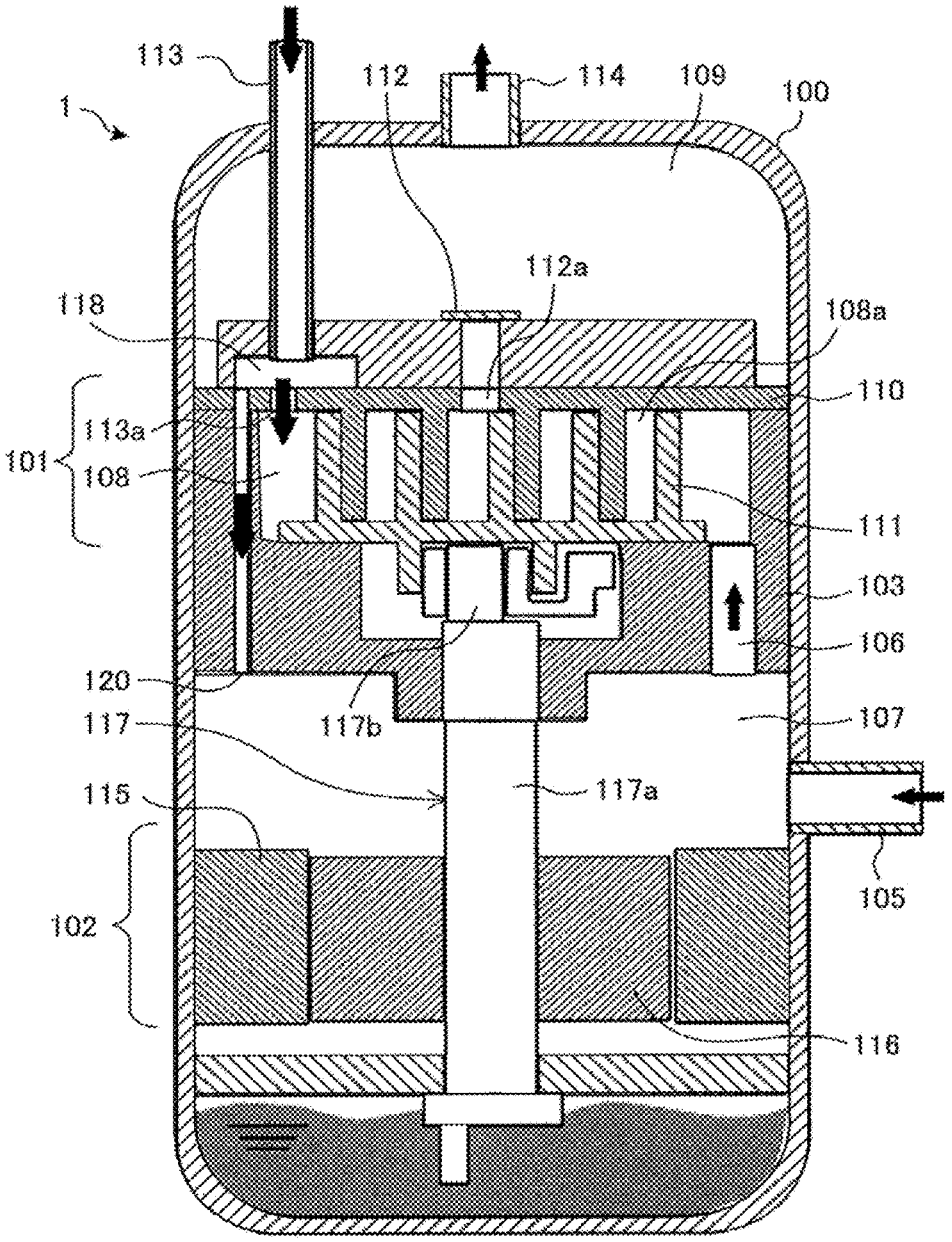
FIG. 8 is an enlarged vertical sectional view showing a compressor of FIG. 7.

FIG. 7 is a schematic circuit diagram showing an example of a circuit configuration of an air-conditioning device according to Embodiment 3 of the present invention, and FIG. 8 is an enlarged vertical sectional view showing a compressor of FIG. 7. Note that in Embodiment 3, components having the same configuration as in the air-conditioning device 200 of FIG. 1 are denoted by the same reference signs and description thereof is omitted.

An air-conditioning device 202 according to Embodiment 3 is different from the air-conditioning device 200 of FIG. 1 in a configuration of an injection circuit 20*a*. The injection circuit 20*a* includes, for example, an injection pipe 10*a* connected at one end to a refrigerant pipe 31 between a first expansion valve 4 and a second expansion valve 5 and coupled at the other end to an injection pipe 113 of a compressor 1 to communicate with a second space portion 108; and an injection valve 8 and a throttle unit 9 provided in the injection pipe 10*a*. As shown in FIG. 8, the injection circuit 20*a* includes a fourth space portion 118 through which the injection pipe 113 communicates with the second space portion 108, and a guide path 120 through which the fourth space portion 118 communicates with a first space portion 107. Note that a refrigerant inflow hole 113*a* provided in an upper end portion of a frame 103 communicates with the injection pipe 113 via the fourth space portion 118.

In the air-conditioning device 202 according to Embodiment 3, low-temperature refrigerant from the injection pipe 10*a* is distributed to the first space portion 107 and the second space portion 108 from the fourth space portion 118. On one hand, the refrigerant flows into the second space portion 108 via the refrigerant inflow hole 113*a*. On the other hand, the refrigerant flows into the first space portion 107 via the guide path 120. In the injection circuit, the fourth space portion 118 is present on an upstream side of the first space portion 107 and the second space portion 108, and the fourth space portion 118 has a higher pressure than the first space portion 107 and the second space portion 108. Consequently, the refrigerant does not flow backward.

Thus, in Embodiment 3, a part of the refrigerant between the first expansion valve 4 and the second expansion valve 5 can be injected simultaneously to the first space portion 107 and the second space portion 108 in the same manner as in Embodiments 1 and 2 described above. The air-conditioning device 202 of Embodiment 3 is different from the air-conditioning device 200 of FIG. 1 in that a first injection pipe 7 between the throttle unit 9 and a suction pipe 105 is not required, and hence, cost reduction and space saving can be achieved.

Note that, in Embodiment 3, inner diameters of the refrigerant inflow hole 113*a* and the guide path 120 are adjusted, so that a flow ratio of the refrigerant flowing through the first space portion 107 and the second space portion 108 can be adjusted.

Embodiment 4

Figure 9:
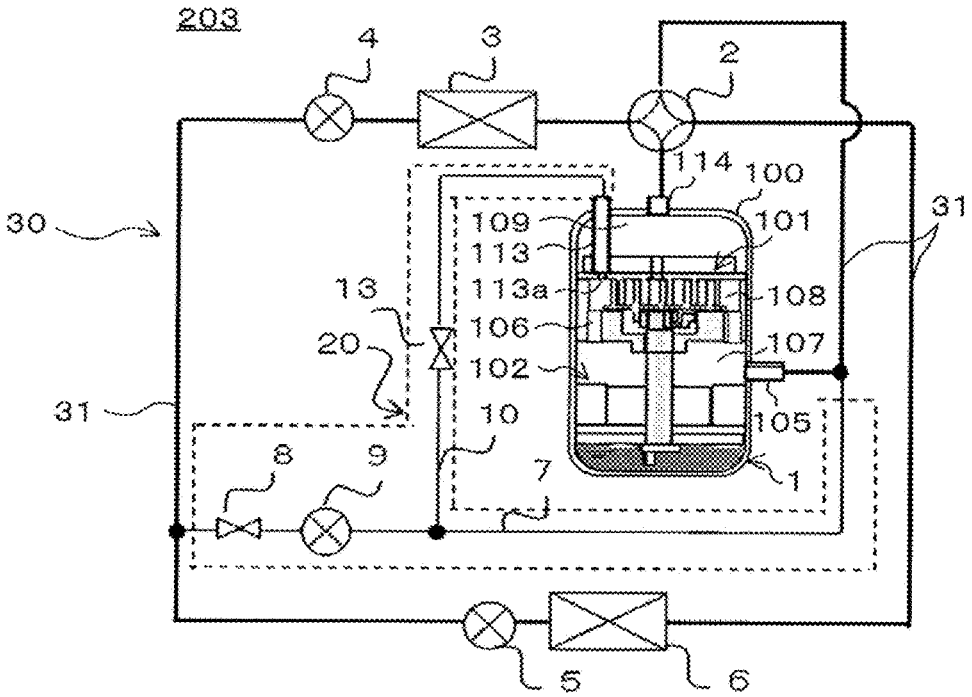
FIG. 9 is a schematic circuit diagram showing an example of a circuit configuration of an air-conditioning device according to Embodiment 4 of the present invention.

FIG. 9 is a schematic circuit diagram showing an example of a circuit configuration of an air-conditioning device according to Embodiment 4 of the present invention. Note that in Embodiment 4, components having the same configuration as in the air-conditioning device 200 of FIG. 1 are denoted by the same reference signs and description thereof is omitted.

An air-conditioning device 203 according to Embodiment 4 is different from the air-conditioning device 200 of FIG. 1 in that a second injection valve 13 is added to an injection circuit 20. That is, a second injection pipe 10 that injects refrigerant to a second space portion 108 of a compressor 1 is provided with the second injection valve 13. When the second injection valve 13 is closed, the refrigerant flowing through the second injection pipe 10 can be only cut off.

Thus, according to Embodiment 4, when the refrigerant is not injected, a part of refrigerant flowing from a four-way valve 2 into a first space portion 107 of the compressor 1 does not flow into the second injection pipe 10 via an injection pipe 113 or does not flow through a first injection pipe 7. Consequently, loss of heat absorbed from outdoor air due to the flow of the refrigerant in the injection circuit 20 can be securely prevented.

Embodiment 5

Figure 10:
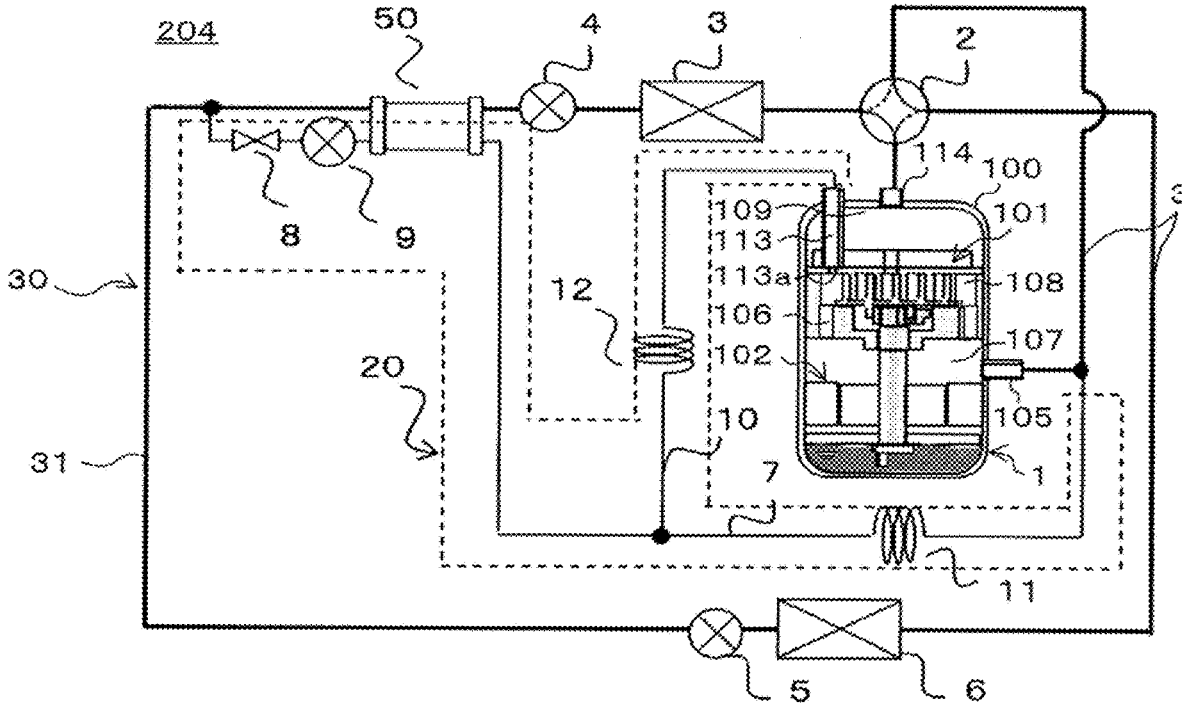
FIG. 10 is a schematic circuit diagram showing an example of a circuit configuration of an air-conditioning device according to Embodiment 5 of the present invention.

FIG. 10 is a schematic circuit diagram showing an example of a circuit configuration of an air-conditioning device according to Embodiment 5 of the present invention. In Embodiment 5, components having the same configuration as in the air-conditioning device 201 of FIG. 6 are denoted by the same reference signs and description thereof is omitted.

An air-conditioning device 204 according to Embodiment 5 is different from the air-conditioning device 201 of FIG. 6 in that a refrigerant heat exchanger 50 is added. The refrigerant heat exchanger 50 is provided at a position in a first injection pipe 7 on a refrigerant outflow side of a throttle unit 9, to exchange heat between refrigerant flowing through a refrigerant pipe 31 between a first expansion valve 4 and a second expansion valve 5 and refrigerant flowing out of the throttle unit 9. In the air-conditioning device 204, a part of the refrigerant flowing through the refrigerant pipe 31 on a high-pressure side bypasses the first injection pipe 7, and is decompressed in the throttle unit 9, to cool the refrigerant flowing through the refrigerant pipe 31. At this time, the refrigerant flowing through the first injection pipe 7 is heated.

Thus, according to Embodiment 5, a flow rate of the refrigerant flowing through the refrigerant pipe 31 on the high-pressure side decreases. Therefore, during a cooling operation mode, it is possible to decrease pressure loss from the high-pressure side refrigerant pipe 31 to a compressor 1 via the first expansion valve 4, an outdoor heat exchanger 3 and a four-way valve 2. During a heating operation mode, it is possible to decrease pressure loss from the second expansion valve 5 to the compressor 1 via an indoor heat exchanger 6 and the four-way valve 2.

Further in Embodiment 5, an opening degree of the throttle unit 9 is adjusted, so that the refrigerant flowing into the first injection pipe 7 can be evaporated in the refrigerant heat exchanger 50 and injected as a low-temperature refrigerant gas to a first space portion 107 and a second space portion 108 of the compressor 1. As a result, viscosity decrease of refrigerating machine oil can be suppressed, and refrigerant leakage caused by the viscosity decrease of the refrigerating machine oil can be inhibited. Consequently, efficiency decrease of the compressor 1 can be prevented.

Note that FIG. 10 does not show a structure of a branch part of an injection circuit 20. However, for example, the refrigerant may flow into the injection circuit in a horizontal direction of a T-branch. Then, the gas refrigerant may flow outside vertically from upside, and liquid refrigerant may flow outside vertically from downside. In this case, a vertical downside outlet of the T-branch is connected to a second injection pipe 10, so that the liquid refrigerant can be guided to the second space portion 108 of the compressor 1. Consequently, for example, a hole diameter of the compressor 1 to which the second injection pipe 10 is connected is decreased. When the pressure loss of the gas refrigerant is large, the liquid refrigerant can be guided to the pipe to acquire the flow rate of the injection refrigerant.

Embodiment 6

Figure 11:
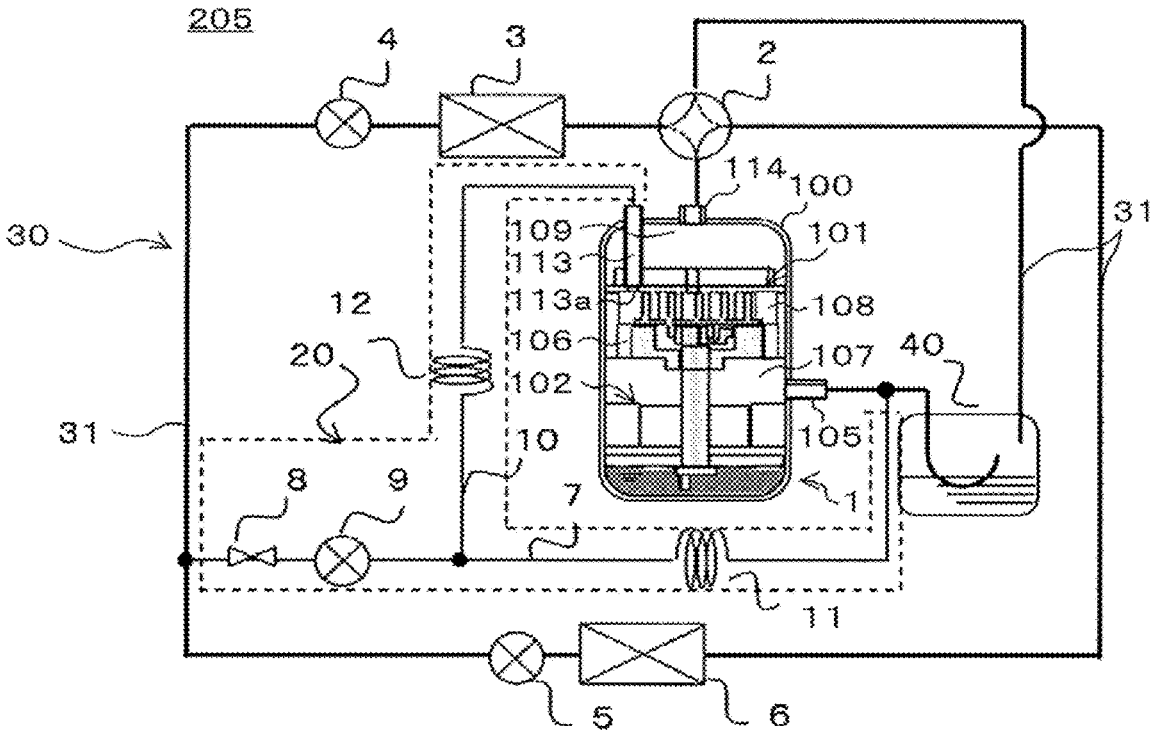
FIG. 11 is a schematic circuit diagram showing an example of a circuit configuration of an air-conditioning device according to Embodiment 6 of the present invention.

FIG. 11 is a schematic circuit diagram showing an example of a circuit configuration of an air-conditioning device according to Embodiment 6 of the present invention. Note that, in Embodiment 6, components having the same configuration as in the air-conditioning device 201 of FIG. 6 are denoted by the same reference signs and description thereof is omitted.

An air-conditioning device 205 according to Embodiment 6 is different from the air-conditioning device 201 of FIG. 6 in that an accumulator 40 is added. The accumulator 40 is provided in a refrigerant pipe between a four-way valve 2 and a compressor 1. In this case, the other end of a first injection pipe 7 is connected to a refrigerant pipe 31 between the accumulator 40 and the compressor 1.

The accumulator 40 stores a part of refrigerant in a refrigerant circuit 30. In the air-conditioning device 201 of FIG. 6, when an opening degree of a second expansion valve 5 is decreased during a heating operation mode, an amount of refrigerant between the second expansion valve 5 and a first expansion valve 4 decreases, and a total amount of refrigerant in the air-conditioning device 201 is constant. Therefore, an amount of refrigerant in an outdoor heat exchanger 3 and an indoor heat exchanger 6 increases. As a result, with the increase of the refrigerant in the outdoor heat exchanger 3, a degree of sub-cooling at an outlet of the outdoor heat exchanger 3 increases, and heat exchange efficiency decreases.

In the air-conditioning device 205 of Embodiment 6, when an opening degree of a second expansion valve 5 is decreased during a heating operation mode, an amount of refrigerant between the second expansion valve 5 and a first expansion valve 4 decreases, but an amount of refrigerant in the accumulator 40 increases. As a result, an amount of refrigerant of an outdoor heat exchanger 3 does not change.

Thus, according to Embodiment 6, even when the opening degree of the second expansion valve 5 is changed during the heating operation mode, the amount of the refrigerant of the outdoor heat exchanger 3 can be kept to be constant. As a result, while keeping heat exchange efficiency of the outdoor heat exchanger 3 constant, a pressure between the first expansion valve 4 and the second expansion valve 5 can be raised. Consequently, an amount of refrigerant flowing into an injection circuit 20 can be increased.

Figure 12:
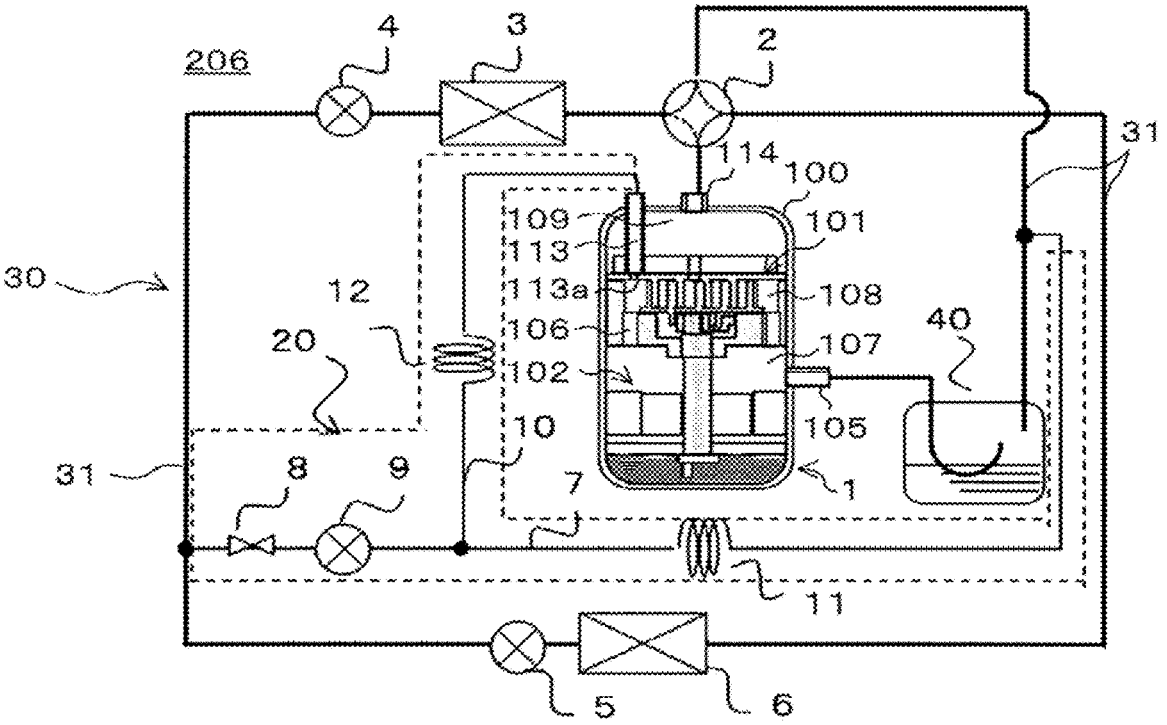
FIG. 12 is a schematic circuit diagram showing a modification of the air-conditioning device of FIG. 11.

In Embodiment 6, the other end of the first injection pipe 7 is connected to the refrigerant pipe 31 between the accumulator 40 and the compressor 1, but may be connected, for example, as shown in FIG. 12. FIG. 12 is a schematic circuit diagram showing a modification of the air-conditioning device of FIG. 11. That is, in an air-conditioning device 206 of FIG. 12, the other end of a first injection pipe 7 of an injection circuit 20 is connected to a refrigerant pipe 31 between a four-way valve 2 and an accumulator 40.

Embodiment 7

Figure 13:
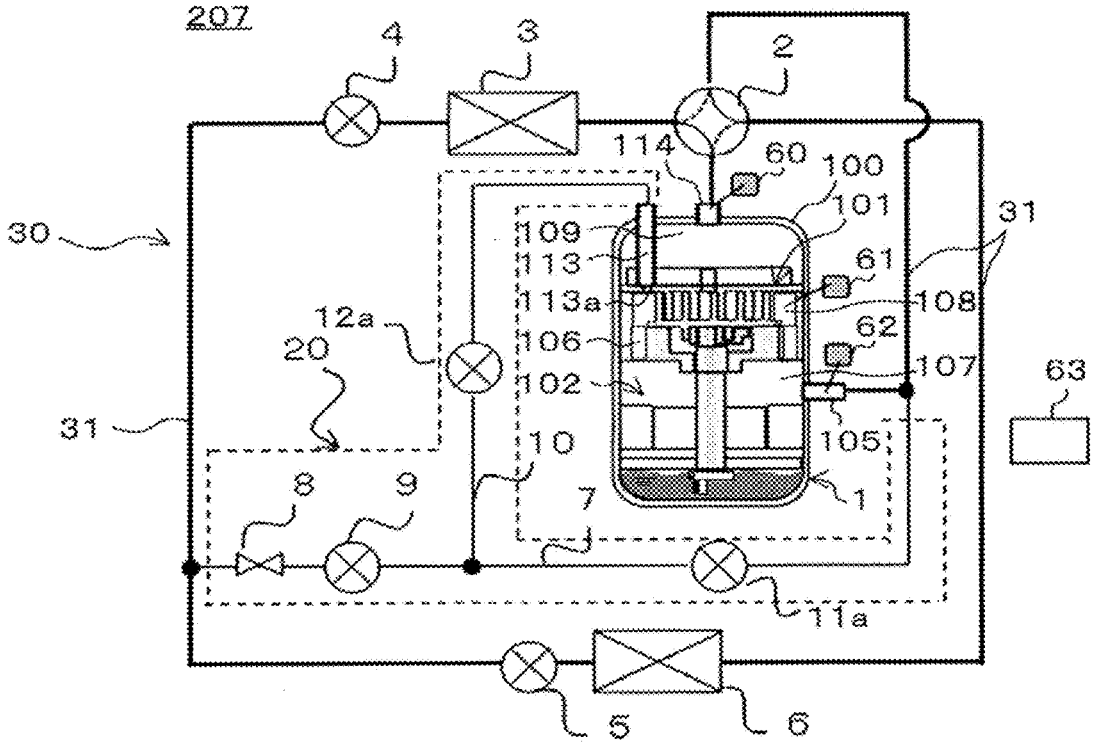
FIG. 13 is a schematic circuit diagram showing an example of a circuit configuration of an air-conditioning device according to Embodiment 7 of the present invention.

FIG. 13 is a schematic circuit diagram showing an example of a circuit configuration of an air-conditioning device according to Embodiment 7 of the present invention. Note that in Embodiment 7, components having the same configuration as in the air-conditioning device 201 of FIG. 6 are denoted by the same reference signs and description thereof is omitted.

An air-conditioning device 207 according to Embodiment 7 is different from the air-conditioning device 201 of FIG. 6 in that a first capillary tube 11 is replaced with a second throttle unit 11*a* and a second capillary tube 12 is replaced with a third throttle unit 12*a*. Further, in the air-conditioning device 207 of FIG. 13, a first temperature detection unit 60, a second temperature detection unit 61, a pressure detection unit 62 and a control unit 63 are added. Note that a throttle unit 9 disposed in series with an injection valve 8 is provided as a first throttle unit in a first injection pipe 7.

The second throttle unit 11*a* is provided in a portion of a first injection pipe 7 on a refrigerant outflow side of the throttle unit 9, and a third throttle unit 12*a* is provided in a second injection pipe 10. The first temperature detection unit 60 is disposed in a discharge pipe 114 of a compressor 1, to detect a discharge temperature of refrigerant passing through the discharge pipe 114. The second temperature detection unit 61 detects a temperature of refrigerant in a second space portion 108 of the compressor 1. The pressure detection unit 62 is provided in a suction pipe 105 of the compressor 1, to detect a pressure of refrigerant flowing through the suction pipe 105. In the second throttle unit 11*a* and the third throttle unit 12*a*, there is used an electronic expansion valve having an adjustable opening degree.

The control unit 63 is provided in a control substrate (not shown) that controls, for example, a rotation speed of an electric motion unit 102 of the compressor 1, opening degrees of first and second expansion valves 4 and 5, opening and closing of the injection valve 8, the opening degrees of the first throttle unit 9, the second throttle unit 11*a* and the third throttle unit 12*a*, flow path switching of a four-way valve 2, and the like. The control unit 63 calculates a quality of the refrigerant in the second space portion 108 from the temperature of the refrigerant in the second space portion 108 which is detected by the second temperature detection unit 61 and the pressure of the refrigerant which is detected by the pressure detection unit 62. When the calculated quality is higher than a set value, the control unit 63 adjusts the opening degree of the second throttle unit 11*a* to lower the temperature of the refrigerant detected by the first temperature detection unit 60.

Furthermore, when the calculated quality is lower than the set value, the control unit 63 adjusts the opening degree of the second throttle unit 11*a* so that an amount of the refrigerant from the first injection pipe 7 does not change, and the control unit increases the opening degree of the third throttle unit 12*a* so that the opening degree is larger than a current opening degree thereof. During a heating operation mode, the control unit 63 controls the third throttle unit 12*a* so that the opening degree of the third throttle unit is larger than the opening degree thereof during a cooling operation mode.

As described above, when the quality of the refrigerant in the second space portion 108 is higher than the set value, the control unit 63 adjusts the opening degree of the second throttle unit 11*a* to lower the temperature of the refrigerant detected by the first temperature detection unit 60. In this case, the refrigerant passing through the first injection pipe 7 is evaporated by heat absorbed from the electric motion unit 102 in a first space portion 107, and liquid refrigerant does not reach the second space portion 108 of a scroll mechanism unit 101. Consequently, it is possible to inhibit refrigerant leakage caused by viscosity decrease of refrigerating machine oil, and hence, efficiency decrease of the compressor 1 due to the refrigerant leakage can be inhibited. However, when the amount of the refrigerant passing through the first injection pipe 7 increases, there is risk that lubrication may be insufficient is generated due to the viscosity decrease of the refrigerating machine oil in a bottom portion of the compressor 1.

To solve the problem, when the quality in the second space portion 108 is lower than the set value due to the injection from the first injection pipe 7, the third throttle unit 12*a* is opened to inject the refrigerant from the second injection pipe 10, while adjusting the opening degree of the second throttle unit 11*a* so that a flow rate of the injection refrigerant from the first injection pipe 7 does not change. The refrigerant passing through the second injection pipe 10 does not flow through an oil reservoir 104 in the bottom portion of the compressor 1, and hence, the viscosity decrease of the refrigerating machine oil can be inhibited.

Thus, according to Embodiment 7, a flow ratio of the refrigerant between the first injection pipe 7 and the second injection pipe 10 can be changed. As a result, the flow ratio does not deviate to one injection pipe, and it is possible to inhibit the viscosity decrease of the refrigerating machine oil, and refrigerant leakage caused by the viscosity decrease of the refrigerating machine oil. Consequently, the efficiency decrease of the compressor 1 due to the refrigerant leakage can be securely inhibited.

Further, in Embodiment 7, the opening degree of the second throttle unit 11*a* and the opening degree of the third throttle unit 12*a* are changed during the cooling operation mode and during the heating operation mode. As described in Embodiment 1, in the injection circuit 20, the discharge temperature of the compressor 1 is lowered, so that it is possible to decrease an amount of heat to be radiated to air from the refrigerant between the compressor 1 and an indoor heat exchanger 6. In a steady state, the amount of the heat to be radiated and an amount of heat to be absorbed are equal while the refrigerant circulates through a refrigerant circuit 30 once. Therefore, an amount of heat to be absorbed in an outdoor heat exchanger 3 decreases due to the above described decrease of the amount of the heat to be radiated, and load on the outdoor heat exchanger 3 can be lowered. As a result, an evaporating temperature of the outdoor heat exchanger 3 rises, and COP can be improved.

However, the COP decreases during the cooling operation mode. This is because an amount of heat to be absorbed in the indoor heat exchanger 6 is required to be constant, to keep a cooling capacity of the air-conditioning device 207 constant. As a result, when the amount of the heat to be radiated to the air from the refrigerant between the compressor 1 and the outdoor heat exchanger 3 decreases, the amount of the heat to be radiated in the outdoor heat exchanger 3 increases. Therefore, when the opening degree of the third throttle unit 12*a* during the heating operation mode is adjusted to be larger than the opening degree thereof during the cooling operation mode, a flow rate of the entire injection refrigerant can be increased to improve the COP.

Thus, the opening degree of the third throttle unit 12*a* is changed during the cooling operation mode and during the heating operation mode, so that the COP can be improved during the heating operation while inhibiting the COP decrease during the cooling operation mode.

REFERENCE SIGNS LIST

1 compressor, 2 four-way valve (a switch valve), 3 outdoor heat exchanger, 4 first expansion valve, 5 second expansion valve, 6 indoor heat exchanger, 7 first injection pipe, 8 injection valve, 9 throttle unit (a first throttle unit), 10 second injection pipe, 10*a* injection pipe, 11 first capillary tube, 11 a second throttle unit, 12 second capillary tube, 12*a* third throttle unit, 13 second injection valve, 20 injection circuit, 30 refrigerant circuit, 31 refrigerant pipe, 40 accumulator, 50 refrigerant heat exchanger, 60 first temperature detection unit, 61 second temperature detection unit, 62 pressure detection unit, 63 control unit, 100 sealed container, 101 scroll mechanism unit, 102 electric motion unit, 103 frame, 104 oil reservoir, 105 suction pipe, 106 communication path, 107 first space portion, 108 second space portion, 108*a* compression chamber, 109 third space portion, 110 fixed scroll, 111 orbiting scroll, 112 discharge valve, 112*a* refrigerant outflow hole, 113 injection pipe, 113*a* refrigerant inflow hole, 114 discharge pipe, 115 stator, 116 rotor, 117 rotary shaft, 117*a* main shaft portion, 117*b* eccentric shaft portion, 118 fourth space portion, 120 guide path, 200 air-conditioning device, 201 air-conditioning device, 202 air-conditioning device, 203 air-conditioning device, 204 air-conditioning device, 205 air-conditioning device, 206 air-conditioning device, and 207 air-conditioning device.

The invention claimed is:

1. An air-conditioning device, comprising:

a refrigerant circuit in which a compressor, a four-way valve, an outdoor heat exchanger, a first expansion valve, a second expansion valve and an indoor heat exchanger are connected by a refrigerant pipe, and an injection circuit, wherein the compressor includes:

a scroll mechanism unit having a fixed scroll and an orbiting scroll that cooperates with the fixed scroll to compress refrigerant, an electric driver that provides revolution movement to the orbiting scroll, a first space portion between the scroll mechanism unit and the electric driver, a second space portion which is annular and is in a circumference of the scroll mechanism unit in a radial direction, a suction pipe connected to the first space portion, from which the refrigerant is sucked into the compressor, a communication path between the first space portion and the second space portion to guide, to the second space portion, the refrigerant sucked from the suction pipe to the first space portion, and a discharge pipe that discharges, to outside of the compressor, the refrigerant that flows from the second space portion into the scroll mechanism unit and is compressed, wherein the injection circuit comprises:

a first injection pipe through which a part of the refrigerant between the first expansion valve and the second expansion valve flows into the first space portion of the compressor, and a second injection pipe through which a part of the refrigerant between the first expansion valve and the second expansion valve directly flows into the second space portion of the compressor, wherein the injection circuit injects a part of the refrigerant between the first expansion valve and the second expansion valve simultaneously from the first injection pipe to the first space portion and from the second injection pipe to the second space portion.

2. The air-conditioning device of claim 1, further comprising:

a first restrictor into which a part of the refrigerant between the first expansion valve and the second expansion valve flows, to adjust a total flow rate of the refrigerant flowing into the first injection pipe and the second injection pipe, wherein the refrigerant is distributed to the first injection pipe and the second injection pipe on a refrigerant outflow side of the first restrictor.

3. The air-conditioning device of claim 2, further comprising:

a refrigerant heat exchanger provided at a position in the first injection pipe on the refrigerant outflow side of the first restrictor, to exchange heat between the refrigerant flowing through the refrigerant pipe between the first expansion valve and the second expansion valve and the refrigerant flowing out of the first restrictor.

4. The air-conditioning device of claim 2, further comprising:

an accumulator in the refrigerant pipe between the four-way valve and the compressor, wherein an other end of the first injection pipe is connected to the refrigerant pipe between the accumulator and the compressor.

5. The air-conditioning device of claim 1, wherein the first injection pipe includes a first restrictor, the second injection pipe includes a second restrictor, and a flow rate in the first injection pipe and a flow rate in the second injection pipe are adjusted independently from each other.

6. The air-conditioning device of claim 5, further comprising:

an accumulator in the refrigerant pipe between the four-way valve and the compressor, wherein an other end of the first injection pipe is connected to the refrigerant pipe between the four-way valve and the accumulator.

7. The air-conditioning device of claim 5, further comprising:

a first temperature detector provided in the discharge pipe of the compressor, to detect a discharge temperature of the refrigerant passing through the discharge pipe, a second temperature detector to detect a temperature of e refrigerant in the second space portion, a pressure detector provided in the suction pipe of the compressor, to detect a pressure of the refrigerant flowing through the suction pipe, and a controller that calculates a quality of the refrigerant in the second space portion from the temperature of the refrigerant detected by the second temperature detector and the pressure of the refrigerant detected by the pressure detector and that, when the calculated quality is higher than a set value, adjusts an opening degree of the first restrictor to lower the discharge temperature of the refrigerant detected by the first temperature detector.

8. The air-conditioning device of claim 7, wherein when the calculated quality is lower than the set value, the controller adjusts the opening degree of the first restrictor so that an amount of the refrigerant from the first injection pipe does not change, and increases an opening degree of the third restrictor so that the opening degree is larger than a current opening degree.

9. The air-conditioning device of claim 5, further, comprising:

a controller that controls an opening degree of each of the first restrictor and the second restrictor, wherein during a heating operation mode, the opening degree of the second restrictor is controlled to be larger than the opening degree of the second restrictor during a cooling operation mode.

10. The air-conditioning device of claim 1, wherein:

the first injection pipe includes a first injection valve, and the second injection pipe includes a second injection valve.

11. The air-conditioning device of claim 1, wherein the injection circuit comprises an injection pipe connected at one end to the refrigerant pipe between the first expansion valve and the second expansion valve, and connected at an other end to the compressor to communicate with the second space portion, and an interior of the compressor includes a guide path that guides at least the refrigerant from the injection pipe to the first space portion.

12. The air-conditioning device of claim 1, wherein:

the first injection pipe and the second injection pipe are connected to each other at an exterior of the compressor.

13. The air-conditioning device of claim 1, wherein:

the first injection pipe and the second injection pipe are connected to different inputs of the compressor.

14. The air-conditioning device of claim 1, wherein:

the first injection pipe and the second injection pipe do not have a common portion.

* * * * *